United States Patent [19]

Ogita

[11] 4,153,652

[45] May 8, 1979

[54] ALTITUDE COMPENSATING SYSTEM OF A CARBURETOR MOUNTED ON A VEHICLE

[75] Inventor: Tamotsu Ogita, Susono, Japan

[73] Assignee: Toyota Jidosha Kogyo Kabushiki Kaisha, Aichi, Japan

[21] Appl. No.: 845,601

[22] Filed: Oct. 26, 1977

[30] Foreign Application Priority Data

Sep. 30, 1977 [JP] Japan ..... 52-116618

[51] Int. Cl.[2] ..... F02M 7/24

[52] U.S. Cl. ..... 261/121 B; 261/39 A; 123/119 D; 123/124 R

[58] Field of Search ..... 261/39 A, 121 B; 123/119 D, 124 R

[56] References Cited

U.S. PATENT DOCUMENTS

| | | | |
|---|---|---|---|
| 2,252,120 | 8/1941 | Ericson | 261/121 B |
| 3,548,792 | 12/1970 | Palmer | 261/121 B |
| 3,810,606 | 5/1974 | Masaki | 261/39 A |
| 3,831,910 | 8/1974 | Shadbolt | 261/39 A |
| 3,857,908 | 12/1974 | Brown et al. | 261/121 B |
| 3,861,366 | 1/1975 | Masaki et al. | 261/121 B |
| 3,906,910 | 9/1975 | Szlaga, Jr. | 261/121 B |
| 3,987,131 | 10/1976 | Hisatomi et al. | 261/121 B |

FOREIGN PATENT DOCUMENTS

| | | | |
|---|---|---|---|
| 2431678 | 1/1975 | Fed. Rep. of Germany | 261/121 B |
| 2559079 | 9/1976 | Fed. Rep. of Germany | 261/121 B |

*Primary Examiner*—Frank W. Lutter
*Assistant Examiner*—Gregory N. Clements
*Attorney, Agent, or Firm*—Kenyon & Kenyon

[57] ABSTRACT

An altitude compensating system of a carburetor for obtaining a desirable enriched air fuel ratio. The system comprises: a device for enriching the air fuel ratio after the engine load has reached a predetermined first value; an altitude compensating valve device for supplying compensating air in accordance with changes in altitude; a control valve device communicated with the altitude compensating valve device for permitting the compensating air to pass after the engine load has reached a predetermined second value, and; a switching valve device disposed at a position between the control valve device and a main jet of a carburetor and interlocked with a throttle valve of the carburetor for switching the compensating air.

The system can enrich the air fuel ratio at low altitude after the engine load has reached a first value and, also, can create a lean air fuel ratio, or only slightly enriched, air fuel ratio, at high altitude after the engine load has reached a predetermined second value, so that the system can prevent the increase of harmful CO and HC contaminants contained in exhaust gas emitted from the engine at high altitude. The system can enrich the air fuel ratio at high altitude when the throttle valve is wide-open.

10 Claims, 11 Drawing Figures

ALTITUDE COMPENSATING SYSTEM OF A CARBURETOR MOUNTED ON A VEHICLE

BACKGROUND OF THE INVENTION

This invention relates to an altitude compensating system of a carburetor mounted on a vehicle, especially to an altitude compensating system which can vary the operating characteristics of a carburetor for obtaining a desirable enriched air fuel ratio in accordance with changes in altitude.

In conventional carburetors, the air fuel ratio is enriched for obtaining increased engine power when the throttle valve of the carburetor is opened. Furthermore, since the conventional carburetors, especially fixed venturi carburetors, mix a certain volume of air with a certain volume of fuel, when a vehicle which has the conventional carburetor mounted thereon is at high altitude, due to the decrease of the atmospheric pressure (and the specific weight of air), the total amount of intake air in weight is decreased, and the air fuel ratio at a given throttle setting is enriched. As a result, harmful contaminants, such as carbon monoxide (CO) and hydro carbon (HC) contained in exhaust gas emitted from the engine are increased and an engine power drop is caused. In addition, since the throttle valve is frequently opened due to the engine power drop at high altitude, the harmful CO and HC contaminants contained in the exhaust gas emitted from the engine can be further increased.

BRIEF SUMMARY OF THE INVENTION

An object of the present invention is to provide an altitude compensating system of a carburetor, which system can obviate the above-mentioned problems and can enrich the air fuel ratio at low altitude after the engine load has reached a predetermined value, and can create a lean air fuel ratio, or only slightly enriched air fuel ratio, at high altitude after the engine has reached the above-mentioned predetermined value, so that the system can prevent the increase of harmful CO and HC contaminants contained in the exhaust gas emitted from the engine.

Another object of the present invention is to provide an altitude compensating system of a carburetor, which system can enrich the air fuel ratio at high altitude when the throttle valve is wide-open.

A further object of the present invention is to provide an altitude compensating system of a carburetor, which system can supply bleed air to the main jet of the carburetor before the engine load has reached a predetermined value and can stop the supply of bleed air to the main jet after the engine load has reached the predetermined value, so that the air fuel ratio is enriched easily under the predetermined engine load conditions.

A still further object of the present invention is to provide an altitude compensating system of a carburetor, which system can supply compensating air supplied from an altitude compensating device in accordance with changes in altitude to the main jet of the carburetor at high altitude, so that the over-enrichment of the air fuel ratio at high altitude can be prevented from occurring.

Other features and advanteges of the invention will be apparent from the detailed description of the invention set forth below with reference to the accompanying drawings.

DETAILED DESCRIPTION OF THE INVENTION

Figure 1:
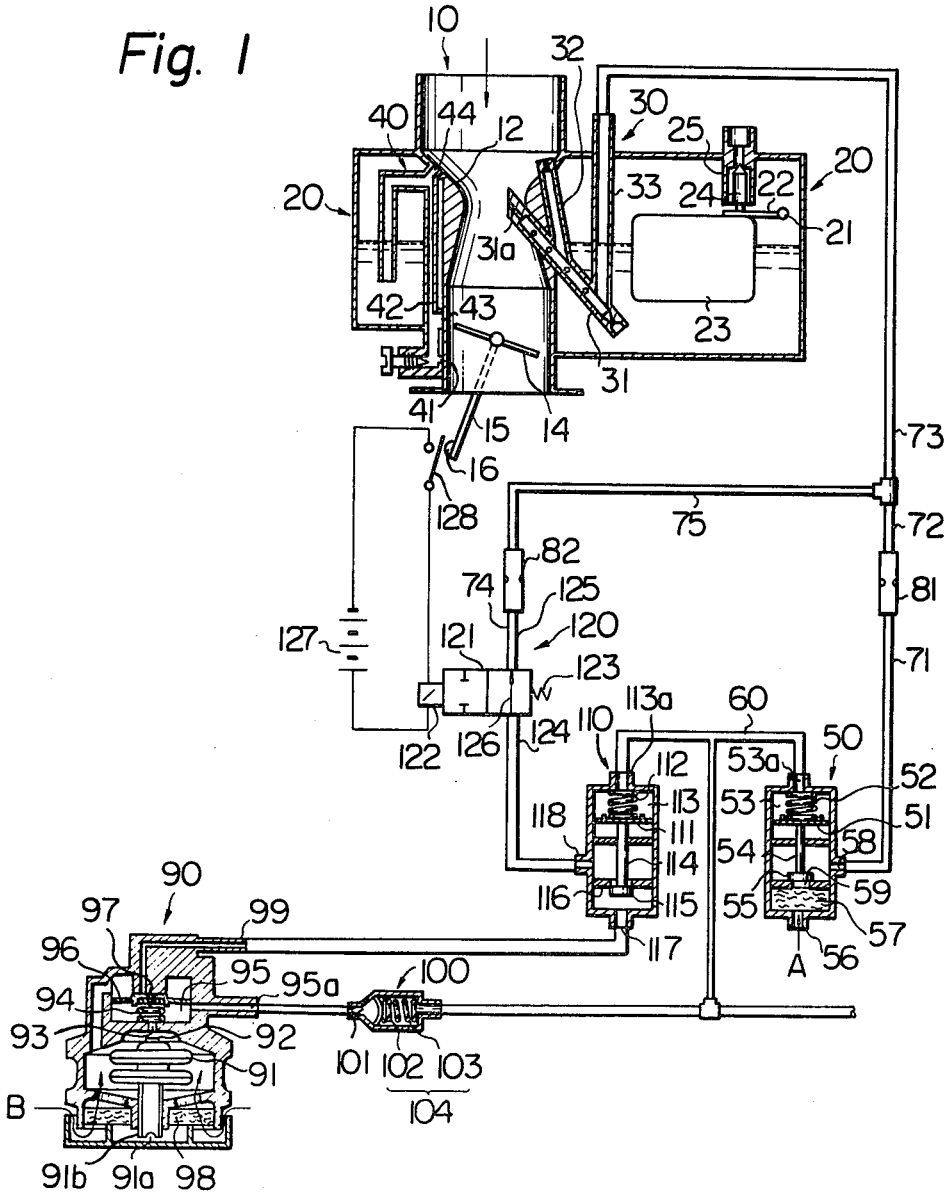
FIG. 1 is a schematic sectional view of an altitude compensating system according to the present invention.
Figure 2A:
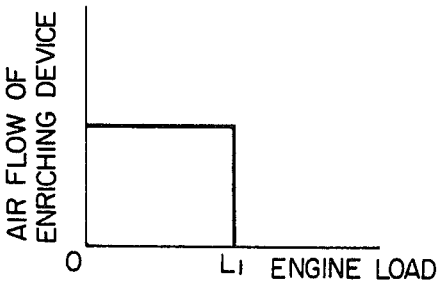
FIGS. 2(*a*) to 2(*e*) are operational diagrams of the system shown in FIG. 1 at low altitude, wherein FIG. 2(*a*) shows the relationship between the engine load and the air flow of the enriching device, FIG. 2(*b*) shows the relationship between the engine load and the air flow of the altitude compensating valve device, FIG. 2(*c*) shows the relationship between the engine load and the air flow of the control valve device, FIG. 2(*d*) shows the relationship between the engine load and the air flow of the switching valve device, and FIG. 2(*e*) shows the relationship between the engine load and the air flow of the altitude compensating system.
Figure 2D:
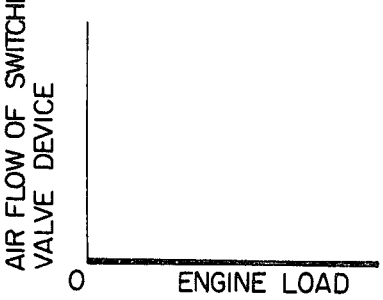
Figure 2B:
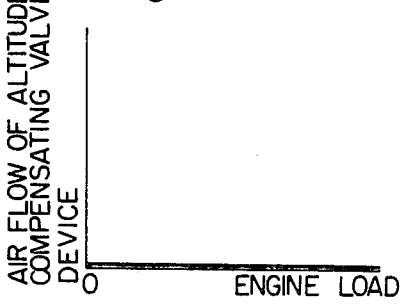
Figure 2E:
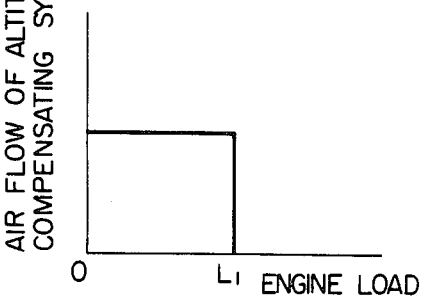
Figure 2C:
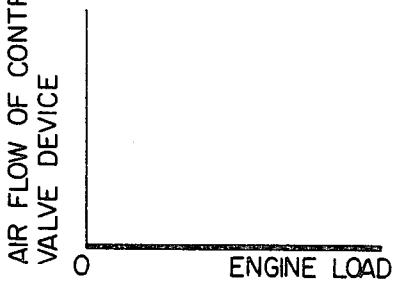
Figure 3A:
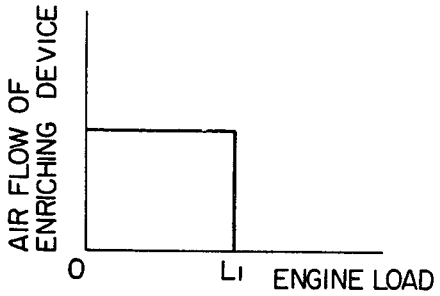
FIGS. 3(*a*) to 3(*e*) are operational diagrams of the system shown in FIG. 1 at high altitude, wherein FIG. 3(*a*) shows the relationship between the engine load and the air flow of the enriching device, FIG. 3(*b*) shows the relationship between the engine load and the air flow of the altitude compensating valve device, FIG. 3(*c*) shows the relationship between the engine load and the air flow of the control valve device, FIG. 3(*d*) shows the relationship between the engine load and the air flow of the switching valve device, and FIG. 3(*e*) shows the relationship between the engine load and the air flow of the altitude compensating system.
Figure 3D:
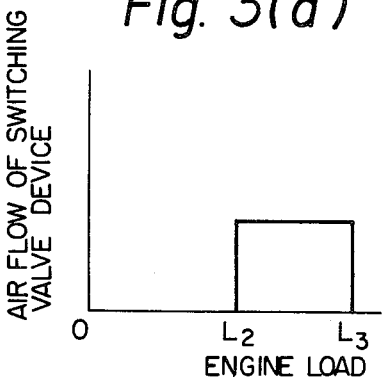
Figure 3B:
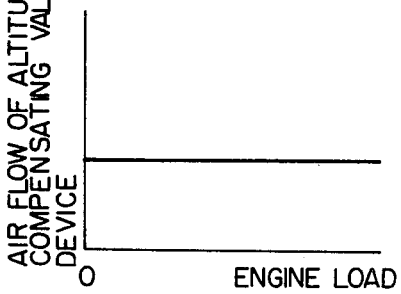
Figure 3E:
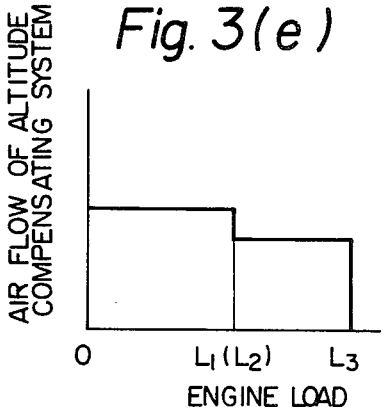
Figure 3C:
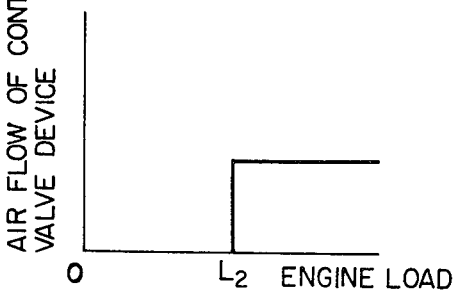

An altitude compensating system according to the present invention will now be explained with reference to the accompanying drawings. Referring to FIG. 1, a carburetor 10 is provided with a venturi throat 12, a throttle valve 14, a main metering system 30 and an idle system 40, each of which systems supplies fuel from a float chamber 20 to the inside of the carburetor 10. The float chamber 20 is provided with a float 23 which is connected to an arm 22 pivoted by a pin 21. Due to the vertical displacement of the float 23, a needle-valve 24 fixed to the arm 22 cooperates with a valve seat 25 and controls the fuel supply from a fuel tank (not shown) communicated with the valve seat 25 so that the fuel level in the float chamber 20 is maintained constant.

The main metering system 30 is provided with a main jet 31, which jet communicates the float chamber 20 with the venturi throat 12 and which jet has a main nozzle 31*a* fixed in the front portion thereof. A main air jet 32 communicates the main jet 31 with a position upstream of the venturi throat 12 and mixes air supplied from the main air jet 32 with fuel in the main jet 31 so that the compensation of the air fuel ratio and the atomization of fuel are increased. The main jet is further provided with a compensating air jet 33. As will be described later, before the engine load has reached a predetermined value, bleed air is supplied to the main jet 31 through the compensating air jet 33, and after the engine load has reached the predetermind value, the supply of bleed air is stopped. As a result, the carburetor 10 can create a desirable enriched air fuel ratio at low altitude. (Of course, the carburetor could also create a desirable enriched air fuel ratio at low altitude by way of another known method.) In addition, as will be described later, at high altitude, altitude compensating air is supplied to the compensating air jet 33 until the wide-open position of the throttle is reached, so that the enrichement of air fuel ratio at high altitude is prevented from occurring.

The idle system 40 is provided with an idle jet 42 which communicates the float chamber 20 with an idle port 41 located downstream of the throttle valve 14. One or more by-pass holes 43, located at a position facing to the edge of the throttle valve 14 in the closed position, and a pilot air jet 44, located at a position upstream of the venturi throat 12, are communicated with the idle jet 42. The idle system 40 supplies fuel to the inside of the carburetor 10, when the engine speed is low (in other words, when the throttle valve 14 is almost closed.).

A control valve device 50 comprises: a diaphragm chamber 53, partitioned by a diaphragm 51, which chamber has a spring 52 therein for urging the diaphragm 51 downwardly; a valve 55 connected to the diaphragm 51 via a valve rod 54, and; a valve seat 59 which cooperates with the valve 55 for controlling the supply of air introduced from an inlet port 56 through a filter 57 to an outlet port 58. A vacuum port 53*a* of the diaphragm chamber 53 is communicated with an intake manifold (not shown) of the engine through a vacuum pipe 60. Accordingly, when the force acting on the diaphragm 51 due to the difference between ambient air pressure and the intake vacuum is larger than the urging force caused by the spring 52 (in other words, when the engine load is low), the valve 55 is opened so that air (arrow A) introduced through the inlet port 56 is supplied to the compensating jet 33 of the main metering system 30 of the carburetor 10 through compensating air pipes 71, 72 and 73, and a throttling element 81.

An altitude compensating device 90 comprises: an aneroid bellows 91 which is filled with a gaseous medium having a predetermined pressure (for example, air having a pressure of 1 kg/cm$^2$) and is vertically displaced in accordance with changes in altitude; a diaphragm chamber 95, partitioned by a diaphragm 96, which chamber 95 has a valve seat 93 cooperated with a valve 92 connected to the top end of the aneroid bellows 91 and which chamber 95 has a spring 94 mounted therein for urging the diaphragm 96 toward another valve seat 97 which cooperates with the diaphragm 96 for controlling air (arrow B) introduced through a filter 98. The valve seat 97 is communicated with an outlet port 99, which port 99 is communicated with a control valve device 110. A vacuum port 95*a* of the diaphragm chamber 95 is communicated with the vacuum pipe 60, communicated with the intake manifold of the engine (not shown), through a valve 100, for preventing the reverse flow of the vacuum from occurring. The valve 100 is provided with a throttling element 101 and a device 104 comprising a stopper valve 102 and a spring 103. Accordingly, when the predetermined altitude has been reached, the aneroid bellows 91 raises the valve 92, and the valve seat 93 is closed. This allows the diaphragm chamber 95 to be evacuated through the vacuum port 95*a*, thereby lowering the diaphragm 96 against the spring 94. As a result, air (arrow B) is supplied to the outlet port 99 through the filter 98 and the valve seat 97. (The altitude compensating device 90 shown in FIG. 1 has the aneroid bellows 91 secured to the body with a screw bolt 91*b* connected to the bottom of the aneroid bellows 91. When the screw bolt 91*b* is turned with a tool (not shown), which is engaged with a notch 91*a* formed at the end of the screw bolt 91*b*, the altitude level at which compensating air is supplied is adjusted to a predetermined value.)

The above-mentioned altitude compensating device 90 can supply a predetermined air flow when the predetermined altitude has been reached. However, instead of the above-mentioned altitude compensating device, an altitude compensating device (not shown) which can supply various air flows in accordance with changes in altitude can be utilized in the present invention.

A control valve device 110 comprises: a diaphragm chamber 113, partitioned by a diaphragm 111, which has a spring 112 for urging the diaphragm 111; a valve 115 connected to the diaphragm 111 via a valve rod 114; and a valve seat 116 which cooperates with the valve 115 for controlling air supplied from the outlet port 99 of the altitude compensating device 90. A vacuum port 113*a* of the diaphragm chamber 113 is communicated with the vacuum pipe 60 which is communicated with the intake manifold of the engine (not shown). As a result; when the force acting on the diaphragm 111 due to the difference between ambient air pressure and the intake vacuum of the engine (not shown) is smaller than the urging force generated by the spring 112, in other words in the low vacuum range (or high load range of the engine), the valve 115 is opened. At that time, air supplied from an inlet port 117 is supplied to a switching valve device 120 through an outlet port 118.

The switching valve device 120 includes a two-way switching electromagnetic valve device 121, which forms a passage 126 for communicating an inlet port 124 with an outlet port 125 by means of a spring 123, when an electric current is not supplied to an electro-magnetic solenoid 122. On the other hand, when an electric current is supplied to the electro-magnetic solenoid 122, the communication between the inlet port 124 and the outlet port 125 is stopped. The electro-magnetic solenoid 122 is connected to a battery 127 and a limit switch 128. The limit switch 128 is actuated by a knocker 16, which consists of a machine screw, fixed to the top end of an arm 15. The arm 15 is secured to the throttle valve 14. The limit switch 128 is closed during wide-open throttle conditions, so as to cause an electric current supply to the electro-magnetic solenoid 122. The outlet port 125 is communicated with the compensating air pipe 73 through compensating air pipes 74 and 75, and a throttling element 82. As a result, when the throttle valve is wide-open, the switching valve device 120 stops the supply of air which is supplied from the control valve device 110. (A switching device (not shown) which is mechanically interlocked with the throttle valve can be utilized in this invention).

The operation of the altitude compensating system of a carburetor according to the present invention will now be explained with reference to the accompanying FIGS. 2(*a*) to 2(*e*) and 3(*a*) to 3(*e*).

(1) LOW ALTITUDE OPERATION

Before the engine load has reached a predetermined value $L_1$, since the intake vacuum is sufficiently high, the compensating air jet 33 of the carburetor 10 (FIG. 1) is supplied air from the control valve device 50 (FIG. 1) (see FIG. 2, the engine load 0 to $L_1$). After the engine load has reached the predetermined value $L_1$, air from the control valve device 50 (FIG. 1) to the compensating air jet 33 (FIG. 1) is stopped. On the other hand, at low altitude, the aneroid bellows 91 of the altitude compensating device 90 (FIG. 1) is lowered and no air is supplied to either the control valve device 110 or the switching valve device 120 (FIGS. 1). As a result, the compensating air jet 33 of the carburetor 10 (FIG. 1)

receives a constant air flow before the engine load has reached the predetermined value $L_1$, and receives no air flow after the engine load has reached the predetermined value $L_1$. (see FIG. 2(*e*)).

(2) HIGH ALTITUDE OPERATION

The operation of the control valve device 50 (FIG. 1) is the same as that described in paragraph (1), (see FIG. 3(*a*)). On the other hand, the altitude compensating device 90 (FIG. 1) introduces constant air flow and supplies it to the control valve device 110 (FIG. 1) (see FIG. 3(*b*)). The control valve device does not permit air to pass therethrough before the engine load has reached a predetermined value $L_2$; however, when the engine load has reached the predetermined value $L_2$ the control valve device permits air to pass toward the switching valve device 120 (FIG. 1) (see FIG. 3(*c*)). The switching valve device 120 (FIG. 1) stops the air supply when the throttle valve 14 (FIG. 1) is wide-open, in other words, when the engine load is above a predetermined value $L_3$ (see FIG. 3(*d*)). As a result, the compensating air jet 33 of the carburetor 10 (FIG. 1) receives air flow according to the diagram shown in FIG. 3(*e*). Consequently, the air fuel ratio enrichment at the increased throttle valve opening at high altitude can be prevented from occurring during the time the engine loads are between $L_2$ and $L_3$, and the air fuel ratio enrichment under the wide-open throttle conditions, when the engine load is above $L_3$, can be obtained.

It is preferable to select the above-mentioned predetermined engine loads $L_1$ and $L_2$ to be substantially the same, so that the compensating air can be continuously supplied from the altitude compensating system according to the present invention in accordance with changes in the engine load at high altitude. The air flow through the enriching device 50 and the air flow through the altitude compensating device 90 at high altitude are selected in accordance with the operating characteristics of the carburetor 10.

What I claim is:

1. An altitude compensating system of a carburetor connected to an intake passage of an engine, the carburetor having a main jet and a throttle valve, for obtaining a desirable enriched air fuel ratio, which comprises:

a means for enriching the air fuel ratio when the engine load is at least equal to a predetermined first value;

an altitude compensating valve means for supplying compensating air in accordance with changes in altitude;

a control valve means communicated with said altitude compensating valve means for permitting said compensating air to pass therethrough when the engine load is at least equal to a predetermined second value, and;

a switching valve means disposed at a position between said control valve means and the main jet of a carburetor and interlocked with the throttle valve of said carburetor for switching said compensating air in response to the position of the throttle valve.

2. An altitude compensating system of a carburetor for obtaining a desirable enriched air fuel ratio according to claim 1, wherein said enriching means comprises a second control valve device which supplies bleed air to said main jet of said carburetor when the engine load is less than said predetermined first value.

3. An altitude compensating system of a carburetor for obtaining a desirable enriched air fuel ratio according to claim 1, wherein said control valve means is connected to the intake passage of the engine downstream of said carburetor for permitting said compensating air to pass when the intake vacuum supplied from said intake passage is lower than a predetermined vacuum corresponding to said predetermined second value of the engine load.

4. An altitude compensating system of a carburetor for obtaining a desirable enriched air fuel ratio according to claim 1 further comprising a member connected to the throttle valve, wherein said switching valve means is actuated by said member connected to said throttle valve of said carburetor for stopping said compensating air from passing under wide-open throttle conditions.

5. An altitude compensating system of a carburetor for obtaining a desirable enriched air fuel ratio according to claim 1, wherein said control valve means is connected to the intake passage of the engine downstream of said carburetor for permitting said compensating air to pass when the intake vacuum supplied from said intake passage is lower than a predetermined vacuum corresponding to said predetermined second value of the engine load, and further comprising a member connected to the throttle, said switching valve means being actuated by said member connected to said throttle valve of said carburetor for stopping said compensating air from passing under wide-open throttle conditions.

6. An altitude compensating system of a carburetor for obtaining a desirable enriched air fuel ratio according to claim 5, wherein said enriching means comprises a second control valve device for enriching the air fuel mixture when the engine load is at least equal to said predetermined first value, and said control valve supplies bleed air to said main jet of said carburetor when the engine load is less than said predetermined first value but stops the supply of bleed air when the engine load is at least equal to said predetermined first value.

7. An altitude compensating system of a carburetor for obtaining a desirable enriched air fuel ratio according to claim 6, wherein said second control valve device is communicated to said intake passage of said engine for supplying said bleed air to said main jet of said carburetor when the engine load is at least equal to said predetermined first value which generates a lower intake vacuum than a predetermined value.

8. An altitude compensating system of a carburetor for obtaining a desirable enriched air fuel ratio according to claim 7, wherein said predetermined first value of said engine load is selected to be substantially the same as said predetermined second value of said engine load.

9. An altitude compensating system of a carburetor for obtaining a desirable enriched air fuel ratio according to claim 5, further comprising a limit switch which is operated by said member connected to said throttle valve of said carburetor for actuating said switching valve means to stop said compensating air from passing under wide-open throttle conditions.

10. An altitude compensating system of a carburetor for obtaining a desirable enriched air fuel ratio according to claim 1, wherein said altitude compensating valve means comprises a diaphragm chamber communicated with the intake passage of the engine downstream of said carburetor and is actuated by the intake vacuum in said passage for controlling the flow of said compensating air, a relief port formed on a wall of said diaphragm chamber for releasing said intake vacuum, a valve for controlling said relief port, and an aneroid bellows filled therein with a medium having a predetermined pressure so as to displace said valve in accordance with the changes in altitude, whereby said altitude compensating valve means supplies said compensating air when atmospheric pressure is lower than a predetermined pressure.

* * * * *